US010093007B2

(12) United States Patent
Chen

(10) Patent No.: US 10,093,007 B2
(45) Date of Patent: Oct. 9, 2018

(54) TORQUE SETTING DEVICE FOR TORQUE WRENCH

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 137 days.

(21) Appl. No.: 15/356,670

(22) Filed: Nov. 21, 2016

(65) Prior Publication Data

US 2018/0141193 A1 May 24, 2018

(51) Int. Cl.
*B25B 23/142* (2006.01)
*B25B 23/00* (2006.01)

(52) U.S. Cl.
CPC ..... *B25B 23/1427* (2013.01)

(58) Field of Classification Search
CPC ..... B25B 23/1427; B25B 23/0007
USPC ..... 81/478
See application file for complete search history.

(56) References Cited

U.S. PATENT DOCUMENTS 4,768,405 A * 9/1988 Nickipuck ..... B25B 15/001 403/325
5,662,012 A * 9/1997 Grabovac ..... B25B 23/1427 81/467
6,463,834 B2 * 10/2002 Kemp ..... B25B 23/1427 81/467

* cited by examiner

*Primary Examiner* — Hadi Shakeri

(57) ABSTRACT

A torque wrench includes a main tube having a driving head and a receiving hole on two ends thereof. A ratchet tube is inserted into receiving hole and has multiple elongate positioning recesses. A passage is defined axially through the ratchet tube. An operation tube is mounted to the ratchet tube and has a driving section and a holding section, and a connection hole is defined through the driving section and the holding section. The driving section has an engaging hole in which a bead is received. A torque unit is received in the receiving hole, the passage and the connection hole. The torque is set by rotating operation tube. A control tube is mounted to the driving section and has a bolt movable in an L-shaped slot to release and restrict movement of the control tube relative to the operation tube.

7 Claims, 6 Drawing Sheets

TORQUE SETTING DEVICE FOR TORQUE WRENCH

BACKGROUND OF THE INVENTION

1. Fields of the Invention

The present invention relates to a torque wrench, and more particularly, to a torque setting device of a torque wrench.

2. Descriptions of Related Art

The conventional way to tighten a bolt is to use a wrench which applies a torque to the bolt so as to rotate the bolt which is then threadedly connected to a threaded hole of an object. The user operates the wrench until he or she feels that the bolt is tightened. Nevertheless, the exact torque that is applied to the bolt is not controlled by the conventional way of operation to the wrench. In some situations, the bolt is designed to be connected to an object under a range of torque. If the torque applied to the bolt is exceeded beyond the range, the bolt will be broken. If the torque applied to the bolt is smaller than the pre-set torque range, the bolt cannot be fixed the object properly.

A torque wrench is developed which generates a click sound when the pre-set torque is reached, the user is acknowledged by the click sound. The value of the torque has to be pre-set before using the wrench, and the setting may be changed by an foreign object touching the torque setting device when using the wrench. Once the set value is changed and the user does not notice the change, the bolt can be damaged when the torque applied to the bolt is over the pre-set value. Alternatively, if the pre-set value is changed to become smaller than the pre-set value, then the bolt cannot be connected to the object as desired.

The present invention intends to provide a torque setting device of a torque wrench, the torque setting device eliminates the shortcomings mentioned above.

SUMMARY OF THE INVENTION

The present invention relates to a torque wrench and comprises a main tube having a driving head connected to the first end thereof, and a receiving hole is defined in the second end of the main tube. A ratchet tube is inserted into receiving hole in the second end of the main tube and has multiple elongate positioning recesses defined axially in the outside thereof. A passage is defined axially through the ratchet tube and communicates with the receiving hole.

An operation tube is mounted to the ratchet tube and has a driving section and a holding section, and a connection hole is defined through the driving section and the holding section. A shoulder is formed between the driving section and the holding section. The driving section has at least one engaging hole which communicates with the connection hole. A bead is received in the at least one engaging hole.

A torque unit is received in the receiving hole of the main tube, the passage of the ratchet tube and the connection hole of the operation tube. The torque unit is compressed and moved by rotating the operation tube. A control tube is mounted to the driving section of the operation tube and has a protrusion extending from the inner periphery thereof. The protrusion has an inclined face. A spring is mounted to the driving section and biased between the protrusion and the shoulder of the operation tube. The control tube is axially moved relative to the operation tube, and the inclined face of the protrusion pushes the bead into the engaging hole and engaged with one of the positioning recesses. The control tube has an L-shaped slot defined in the outside thereof. A bolt extends into the L-shaped hole and is connected to the driving section. The bolt is movable along the L-shaped slot to restrict or release the movement of the control tube relative to the operation tube.

Preferably, the L-shaped slot of the control tube includes a straight section and a transverse section which communicates with the straight section. The bolt is located in the straight section to form a release status and the control tube is axially movable relative to the operation tube. When in a release status, the bolt is located in the straight section and the control tube is axially movable relative to the operation tube. When in a restriction status, the bolt is located in the transverse section and the control tube is not axially movable relative to the operation tube.

Preferably, the bolt includes a head and a shank. The head is located in the L-shaped slot and has a hexagonal hole. The shank has outer threads defined in the outside thereof. The outer threads are threadedly connected to inner threads of a locking hole defined in the driving section of the operation tube.

Preferably, the main tube includes two radial holes defined in the second end thereof. The radial holes communicate with the receiving hole. The ratchet tube has two insertion holes which are located corresponding to the radial holes. Two pins respectively extend through the two radial holes and the two insertion holes.

Preferably, the torque unit includes a spring, a threaded rod and a control member. The spring is received in the main tube and biased between the driving head and a contact plate on one end of the threaded rod. The threaded rod extends into the receiving hole of the main tube. The passage of the ratchet tube, the connection hole of the operation tube and the control member. The control member is fixed to the operation tube. A nut is threadedly connected to the threaded rod and located between the control member and the ratchet tube. The control member has a control slot that faces the nut. The operation tube moves to merge the nut in the control slot. The nut moves along the threaded rod when the operation tube rotates, the threaded rod moves toward the spring and pushes the contact plate to compress the spring.

Preferably, the control tube includes a notch defined in the inner periphery thereof. The notch is located beneath the protrusion. The operation tube has a groove which faces the notch. A rubber ring is engaged with the notch and the groove. The rubber ring prevents the control tube from rotation relative to the operation tube.

Preferably, the operation tube includes a cap which is engaged with the connection hole. The threaded rod extends through the cap.

The primary object of the present invention is to provide a torque setting device of a torque wrench, and the torque setting device is not changed by being unintentionally touched.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
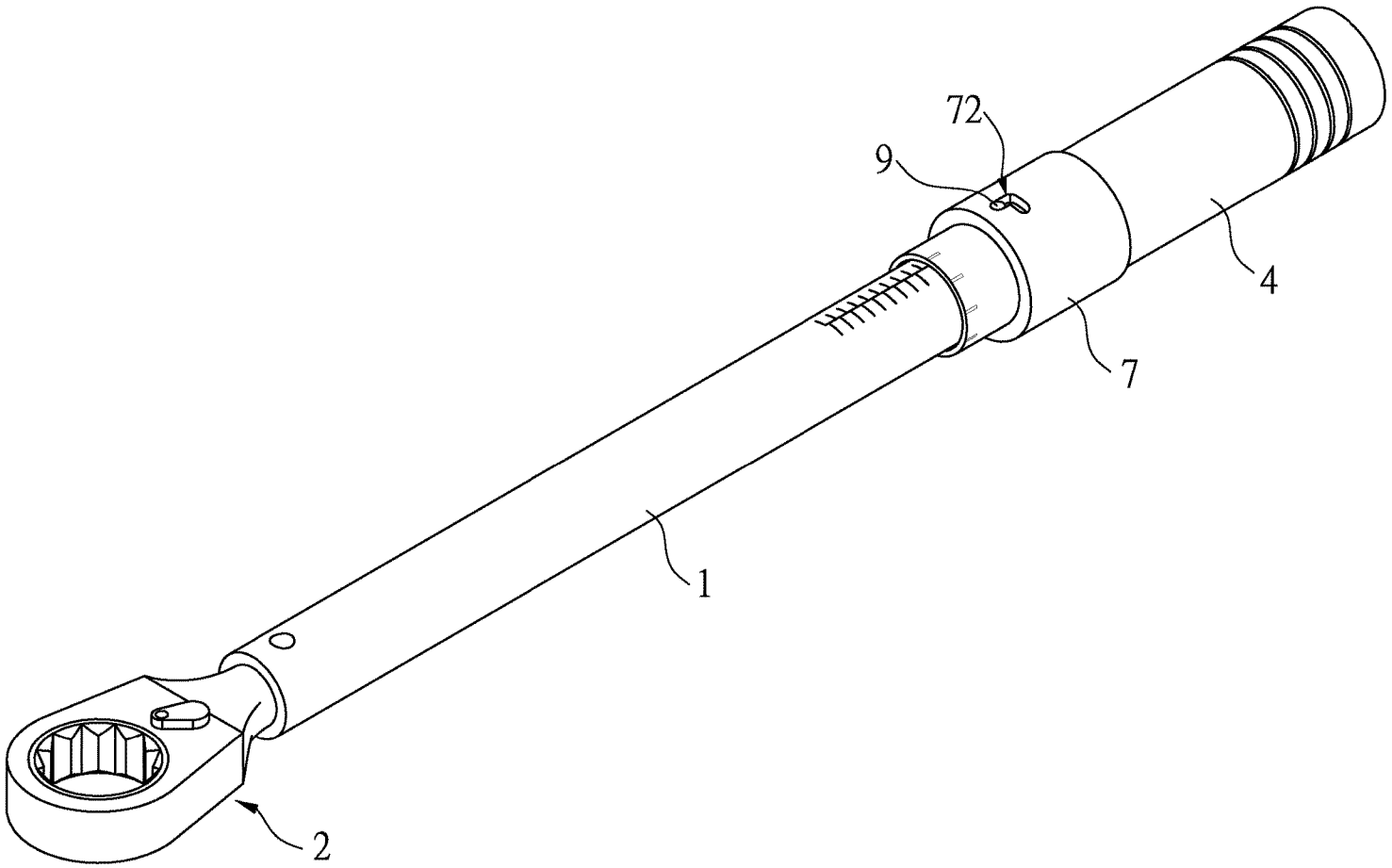
FIG. 1 is a perspective view of the torque wrench of the present invention.

Referring to FIGS. 1 to 8, the torque wrench of the present invention comprises a main tube 1 having a driving head 2 connected to the first end thereof, and a receiving hole 11 is defined in the second end of the main tube 1. A ratchet tube 3 is inserted into receiving hole 11 in the second end of the main tube 1 and has multiple elongate positioning recesses 31 defined axially in the outside thereof. Preferably, the positioning recesses 31 are separated at even intervals. A passage 32 is defined axially through the ratchet tube 3 and communicates with the receiving hole 11.

An operation tube 4 is mounted to the ratchet tube 3 and has a driving section 41 and a holding section 42, and a connection hole 43 is defined through the driving section 41 and the holding section 42. A shoulder 44 is formed at the connection portion between the driving section 41 and the holding section 42. The diameter of the driving section 41 is smaller than that of the holding section 42. The driving section 41 has at least one engaging hole 411 which communicates with the connection hole 43. A bead 5 is received in the at least one engaging hole 411.

A torque unit 6 is received in the receiving hole 11 of the main tube 11, the passage 32 of the ratchet tube 3 and the connection hole 43 of the operation tube 4. The torque unit 6 is compressed and moved by rotating the operation tube 4 so as to set the torque of the torque wrench.

A control tube 7 is mounted to the driving section 41 of the operation tube 4 and has a protrusion 71 extending from the inner periphery thereof. The protrusion 71 has an inclined face 711. A spring 8 is mounted to the driving section 41 and biased between the protrusion 71 and the shoulder 44 of the operation tube 4. The control tube 7 is axially moved relative to the operation tube 4, and the inclined face 711 of the protrusion 71 pushes the bead 5 into the engaging hole 411 and engaged with one of the positioning recesses 31. The control tube 7 has an L-shaped slot 72 defined in the outside thereof. A bolt 9 extends into the L-shaped hole 72 and is connected to the driving section 41. The bolt 9 is movable along the L-shaped slot 72 to restrict or release the movement of the control tube 7 relative to the operation tube 4. Thanks to the bolt 9 and the L-shaped slot 72, the set value of the torque is not changed even if the control tube 7 is touched after the setting processes are done.

When setting the value of the torque, the user rotates control tube 7 is rotated relative to the operation tube 4 to release the control tube 7 so that the control tube 7 is freely movable. The control tube 7 is then pushed to set the bead 5 not to be engaged with the positioning recess 31 and the spring 8 is compressed. The user then rotates the operation tube 4 to control the operation of the torsion unit 6. After the value of the torsion is set, the spring 8 is released and the restoration force of the spring 8 moves the control tube 7 back to its initial position. The inclined face 711 of the protrusion 71 push the bead 5 to be merged into the engaging hole 411 and engaged with the positioning recess 31. The bead 5 is engaged with the positioning recess 31 prevents the operation tube 4 from rotating to change the set value of torque. The control tube 7 is then rotated relative to the operation tube 4 to move the bolt 9 along the L-shaped slot 72 to further restrict the control tube 7 from moving. The engagement between the bead 5 and the positioning recess 31 restricts the rotation of the operation tube 4. The cooperation between the bolt 9 and the L-shaped slot 72 restricts the control tube 7 from rotation relative to the operation tube 4. Therefore, the set value of torque cannot be changed.

Figure 2:
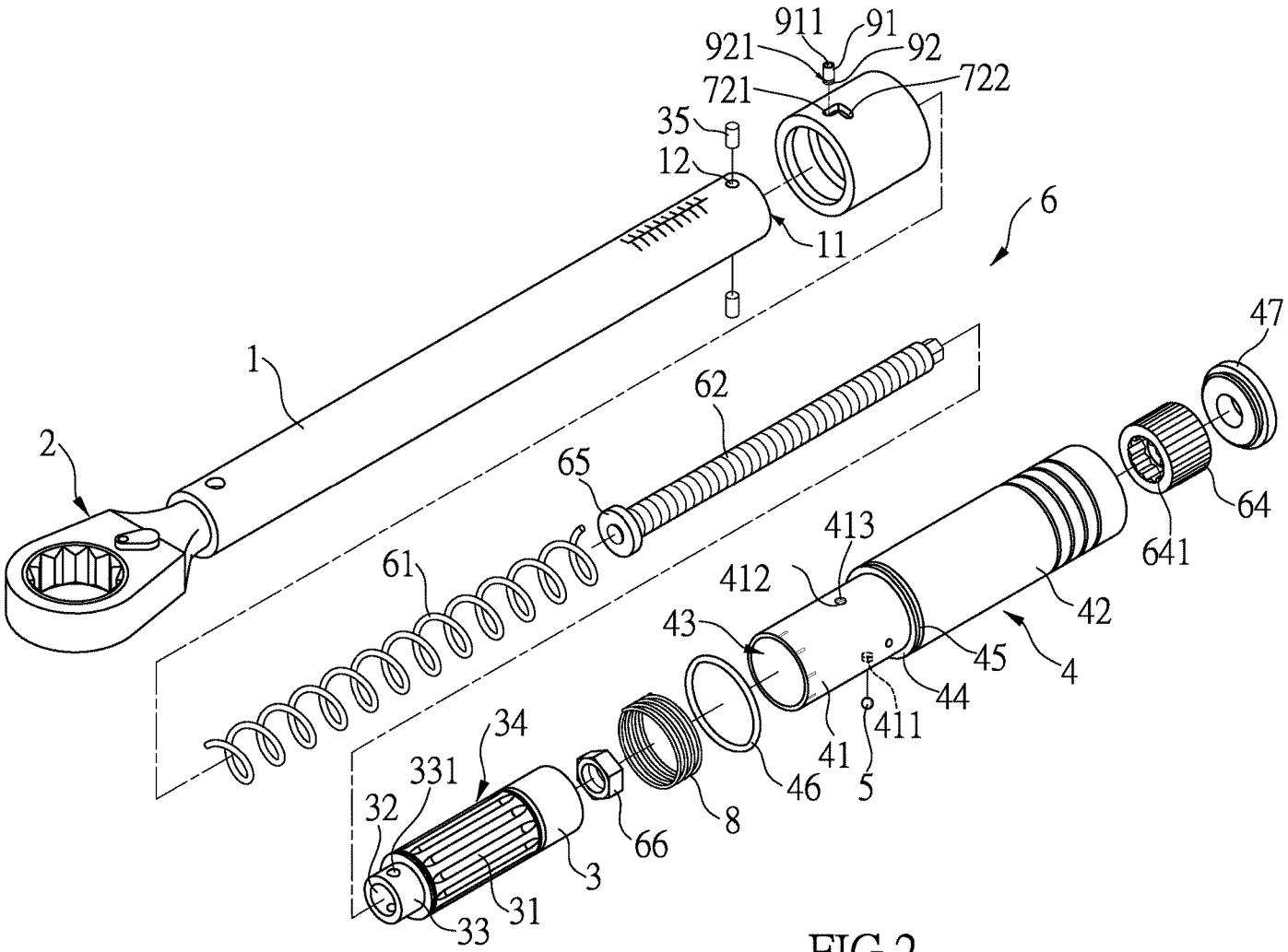
FIG. 2 is an exploded view to show the torque wrench of the present invention.
Figure 3:
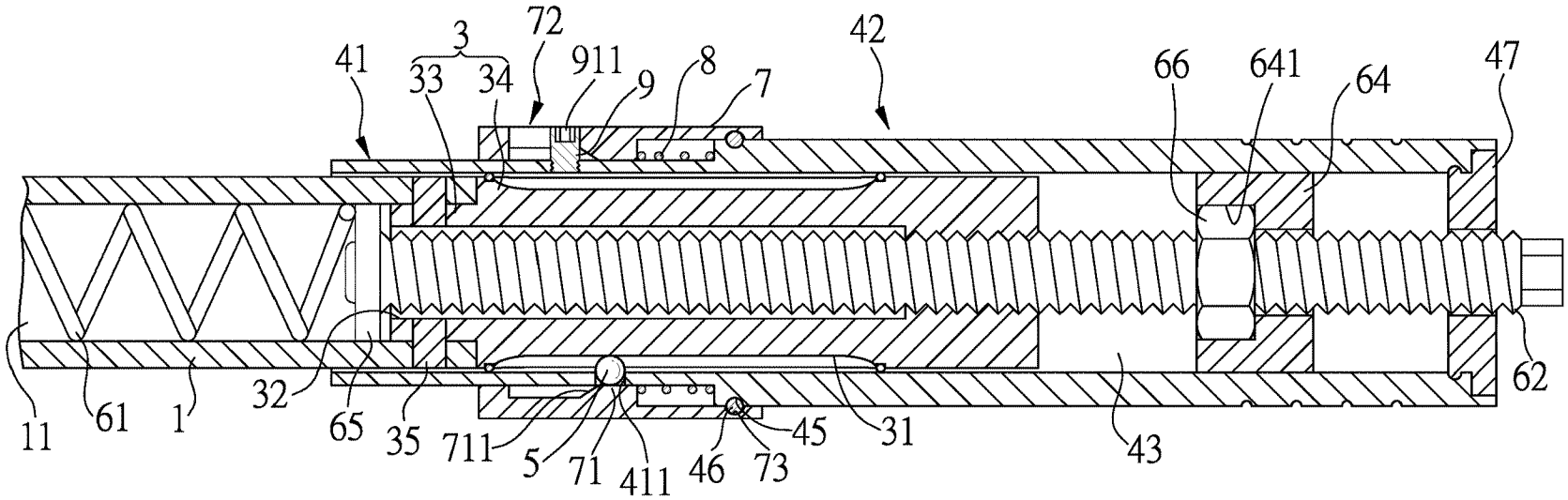
FIG. 3 is a cross sectional view of the torque wrench of the present invention.
Figure 4:
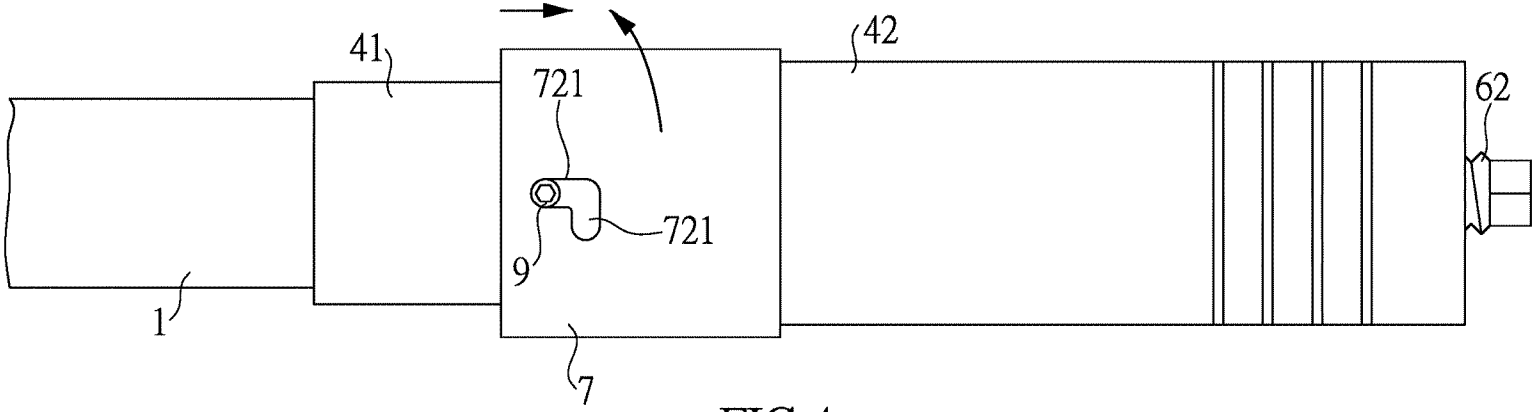
FIG. 4 shows that the control tube is pushed, and the bolt is located in the straight section of the L-shaped slot.
Figure 7:
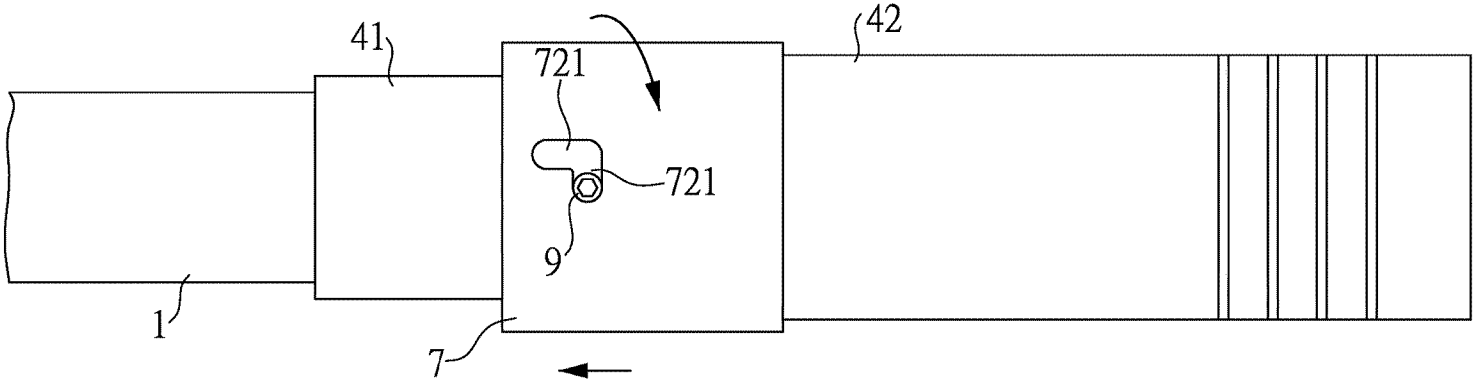
FIG. 7 shows that after the threaded rod is set, the control tube is rotated to set the bolt in the transverse section of the L-shaped slot.

As shown in FIGS. 4 and 7, the L-shaped slot 72 of the control tube 7 includes a straight section 721 and a transverse section 722 which communicates with the straight section 721. The bolt 9 is located in the straight section 721 to form a release status and the control tube 7 is axially movable relative to the operation tube 4. When in a release status, the bolt 9 is located in the straight section 721 and the control tube 7 is axially movable relative to the operation tube 4 to set the value of torque. When in a restriction status, the bolt 9 is located in the transverse section 722 and the control tube 7 is not axially movable relative to the operation tube 4. As shown in FIG. 2, the bolt 9 includes a head 91 and a shank 92, the head 91 is located in the L-shaped slot 72 and has a hexagonal hole 911, the shank 92 has outer threads 921 defined in an outside thereof, the outer threads 921 are threadedly connected to inner threads 413 of a locking hole 412 defined in the driving section 41 of the operation tube 4. The user can insert a hexagonal wrench in the hexagonal hole 911 to rotate the bolt 9 to adjust the status between the locking hole 412 and the bolt 9.

The main tube 1 includes two radial holes 12 defined in the second end thereof, the radial holes 12 communicate with the receiving hole 11. The ratchet tube 3 includes a connection section 33 and a mounting section 34, wherein the connection section 33 is inserted into the main tube 1, and the diameter of the mounting section 34 is the same as that of the main tube 1. The ratchet tube 3 has two insertion holes 331 which are located corresponding to the radial holes 12. Two pins 35 respectively extend through the two radial holes 12 and the two insertion holes 331 to securely connect the ratchet tube 3 to the main tube 1, and bead 5 is precisely engaged with the positioning recess 31.

Figure 5:
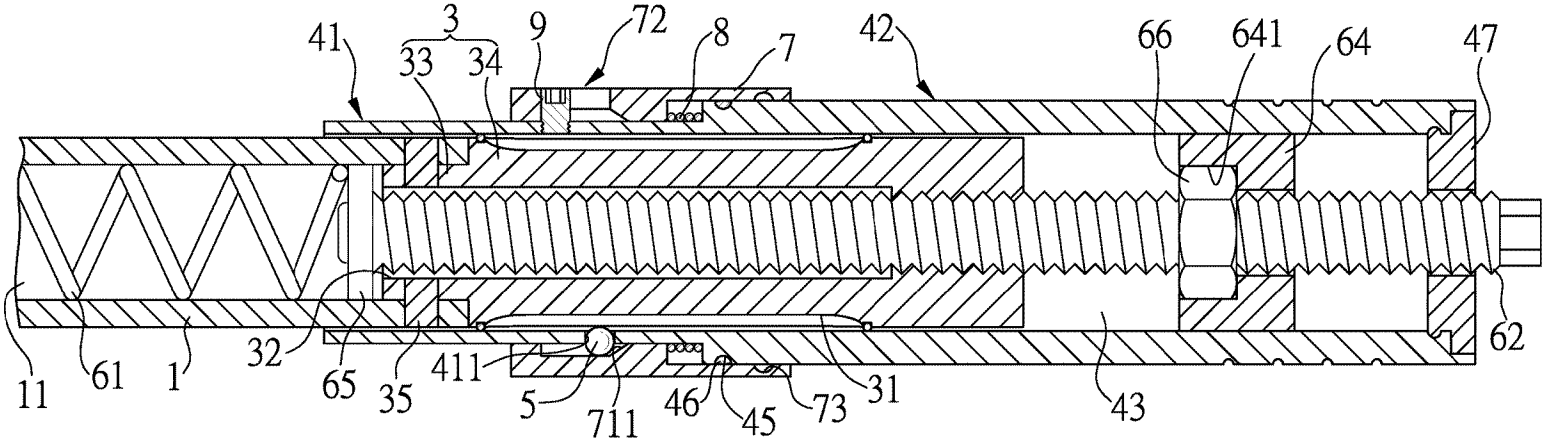
FIG. 5 shows that the control tube is pushed, and the spring is compressed by the protrusion.
Figure 6:
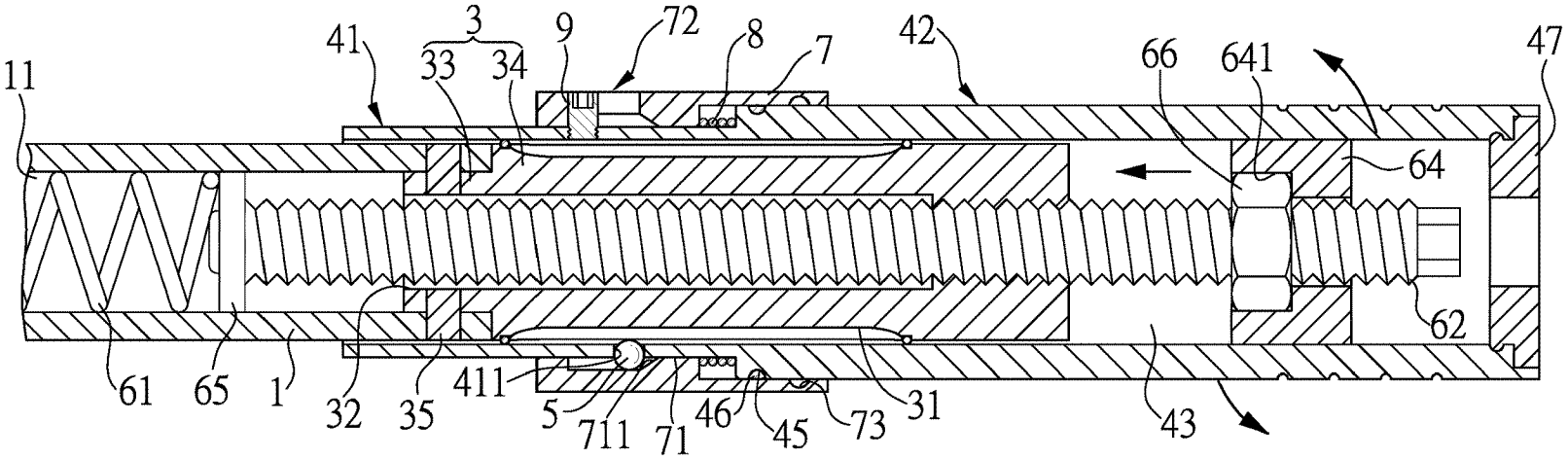
FIG. 6 shows that the operation tube is rotated and the contact plate of the threaded rod is moved to compress the spring.
Figure 8:
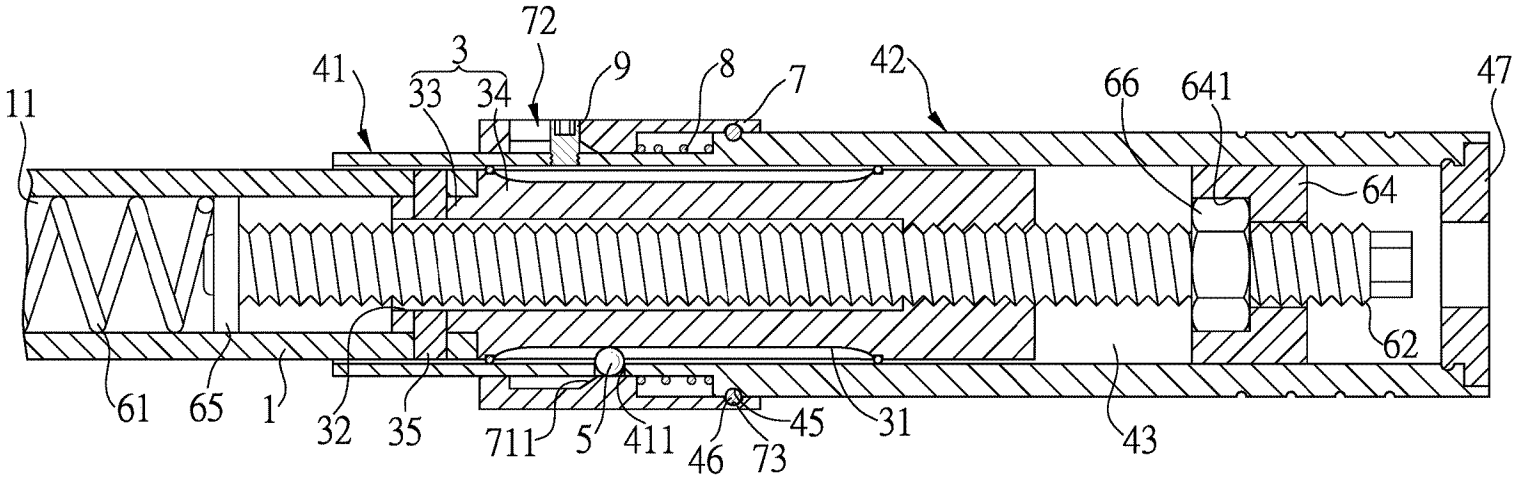
FIG. 8 shows that the control tube returns after the setting is completed, the inclined face of the protrusion pushes the bead into the recess and engaged with one of the positioning recesses.

The control tube 7 includes a notch 73 defined in the inner periphery thereof. The notch 73 is located beneath the protrusion 71. The operation tube 4 has a groove 45 which faces the notch 73. A rubber ring 46 is engaged with the notch 73 and the groove 45. The rubber ring 46 prevents the control tube 7 from rotation relative to the operation tube 4 due to friction. This prevents the stored force of the spring 8 from driving the control tube 7 out from the operation tube 4 when the control tube 7 moves back to its initial position. As shown in FIGS. 5, 6 and 8, in order to prevent foreign objects from entering the operation tube 4, the operation tube 4 includes a cap 47 which is engaged with the connection hole 43, the threaded rod 62 extends through the cap 47.

The torque unit 6 includes a spring 61, a threaded rod 62 and a control member 64. The spring 61 is received in the main tube 1 and biased between the driving head 2 and a contact plate 65 on one end of the threaded rod 62. The threaded rod 62 extends into the receiving hole 11 of the main tube 1, the passage 32 of the ratchet tube 3, the connection hole 43 of the operation tube 4 and the control member 64. The control member 64 is fixed to the operation tube 4. A nut 66 is threadedly connected to the threaded rod 62 and located between the control member 64 and the ratchet tube 3. The control member 64 has a control slot 641 that faces the nut 66. The operation tube 4 moves to merge the nut 66 in the control slot 641, the nut 66 moves along the threaded rod 62 when the operation tube 4 rotates. The threaded rod 62 moves toward the spring 61 and pushes the contact plate 65 to compress the spring 61.

While we have shown and described the embodiment in accordance with the present invention, it should be clear to those skilled in the art that further embodiments may be made without departing from the scope of the present invention.

What is claimed is:

1. A torque wrench comprising:

a main tube (1) having a driving head (2) connected to a first end thereof, a receiving hole (11) defined in a second end of the main tube (1);

a ratchet tube (3) inserted into receiving hole (11) in the second end of the main tube (1) and having multiple elongate positioning recesses (31) defined axially in an outside thereof, a passage (32) defined axially through the ratchet tube (3) and communicating with the receiving hole (11);

an operation tube (4) mounted to the ratchet tube (3) and having a driving section (41) and a holding section (42), a connection hole (43) defined through the driving section (41) and the holding section (42), a shoulder (44) formed at a connection portion between the driving section (41) and the holding section (42), the driving section (41) having at least one engaging hole (411) which communicates with the connection hole (43), a bead (5) received in the at least one engaging hole (411);

a torque unit (6) received in the receiving hole (11) of the main tube (11), the passage (32) of the ratchet tube (3) and the connection hole (43) of the operation tube (4), the torque unit (6) being compressed and moved by rotating the operation tube (4), and a control tube (7) mounted to the driving section (41) of the operation tube (4) and having a protrusion (71) extending from an inner periphery thereof, the protrusion (71) having an inclined face (711), a spring (8) mounted to the driving section (41) and biased between the protrusion (71) and the shoulder (44) of the operation tube (4), the control tube (7) axially moved relative to the operation tube (4), and the inclined face (711) of the protrusion (71) pushing the bead (5) into the engaging hole (411) and engaged with one of the positioning recesses (31), the control tube (7) having an L-shaped slot (72) defined in an outside thereof, a bolt (9) extending into the L-shaped hole (72) and connected to the driving section (41), the bolt (9) movable along the L-shaped slot (72) to restrict or release a movement of the control tube (7) relative to the operation tube (4).

2. The torque wrench as claimed in claim 1, wherein the L-shaped slot (72) of the control tube (7) includes a straight section (721) and a transverse section (722) which communicates with the straight section (721), the bolt (9) is located in the straight section (721) to form a release status and the control tube (7) is axially movable relative to the operation tube (4), when in a release status, the bolt (9) is located in the straight section (721) and the control tube (7) is axially movable relative to the operation tube (4), when in a restriction status, the bolt (9) is located in the transverse section (722) and the control tube (7) is not axially movable relative to the operation tube (4).

3. The torque wrench as claimed in claim 2, wherein the bob (9) includes a head (91) and a shank (92), the head (91) is located in the L-shaped slot (72) and has a hexagonal hole (911), the shank (92) has outer threads (921) defined in an outside thereof, the outer threads (921) are threadedly connected to inner threads (413) of a locking hole (412) defined in the driving section (41) of the operation tube (4).

4. The torque wrench as claimed in claim 1, wherein the main tube (1) includes two radial holes (12) defined in the second end thereof, the radial holes (12) communicate with the receiving hole (11), the ratchet tube (3) has two insertion holes (331) which are located corresponding to the radial holes (12), two pins (35) respectively extend through the two radial holes (12) and the two insertion holes (331).

5. The torque wrench as claimed in claim 4, wherein the torque unit (6) includes a spring (61), a threaded rod (62) and a control member (64), the spring (61) is received in the main tube (1) and biased between the driving head (2) and a contact plate (65) on one end of the threaded rod (62), the threaded rod (62) extends into the receiving hole (11) of the main tube (1), the passage (32) of the ratchet tube (3), the connection hole (43) of the operation tube (4) and the control member (64), the control member (64) is fixed to the operation tube (4), a nut (66) is threadedly connected to the threaded rod (62) and located between the control member (64) and the ratchet tube (3), the control member (64) has a control slot (641) that faces the nut (66), the operation tube (4) moves to merge the nut (66) in the control slot (641), the nut (66) moves along the threaded rod (62) when the operation tube (4) rotates, the threaded rod (62) moves toward the spring (61) and pushes the contact plate (65) to compress the spring (61).

6. The torque wrench as claimed in claim 5, wherein the operation tube (4) includes a cap (47) which is engaged with the connection hole (43), the threaded rod (62) extends through the cap (47).

7. The torque wrench as claimed in claim 1, wherein the control tube (7) includes a notch (73) defined in an inner periphery thereof, the notch (73) is located beneath the protrusion (71), the operation tube (4) has a groove (45) which faces the notch (73), a rubber ring (46) is engaged with the notch (73) and the groove (45), the rubber ring (46) prevents the control tube (7) from rotation relative to the operation tube (4).

* * * * *